US008928575B2

(12) United States Patent
Moriya et al.

(10) Patent No.: US 8,928,575 B2
(45) Date of Patent: Jan. 6, 2015

(54) ELECTROPHORETIC DISPLAY DEVICE, ELECTRONIC APPARATUS, AND METHOD OF DRIVING ELECTROPHORETIC DISPLAY DEVICE

(75) Inventors: Soichi Moriya, Suwa (JP); Tsutomu Miyamoto, Shiojiri (JP)

(73) Assignee: Seiko Epson Corporation (JP)

( * ) Notice: Subject to any disclaimer, the term of this patent is extended or adjusted under 35 U.S.C. 154(b) by 1044 days.

(21) Appl. No.: 12/243,279

(22) Filed: Oct. 1, 2008

(65) Prior Publication Data

US 2009/0096722 A1 Apr. 16, 2009

(30) Foreign Application Priority Data

Oct. 16, 2007 (JP) ..... 2007-269426

(51) Int. Cl.
*G09G 3/34* (2006.01)

(52) U.S. Cl.
CPC ..... *G09G 3/344* (2013.01); *G09G 2300/0842* (2013.01); *G09G 2300/0876* (2013.01); *G09G 2310/063* (2013.01)
USPC ..... 345/107

(58) Field of Classification Search
CPC .... G09G 3/344; G09G 3/3446; G09G 3/3453
USPC ..... 345/30, 76, 107
See application file for complete search history.

(56) References Cited

U.S. PATENT DOCUMENTS

2006/0077190 A1* 4/2006 Zhou et al. ..... 345/204
2006/0138600 A1* 6/2006 Miyazawa ..... 257/630
2006/0139309 A1* 6/2006 Miyasaka ..... 345/107
2006/0232547 A1* 10/2006 Johnson et al. ..... 345/107
2007/0046622 A1* 3/2007 Kawai ..... 345/107
2007/0200819 A1* 8/2007 Song ..... 345/107
2008/0094315 A1* 4/2008 Johnson et al. ..... 345/58

FOREIGN PATENT DOCUMENTS

JP 2002-149115 5/2002

OTHER PUBLICATIONS

"Bias-Induced Threshold Voltages Shifts in Thin-Film Organic Transistors", H. L. Gomes, P. Stallinga, et al., Applied Physics Letters, vol. 84, No. 16, Apr. 19, 2004, p. 3184-p. 3186.
"Light Induced Bias Stress Reversal in Polyfluorene Thin-Film Transistors", A. Salleo, R.A. Street, Journal of Applied Physics, vol. 94, No. 1, Jul. 1, 2003, p. 471-p. 479.

* cited by examiner

*Primary Examiner* — Jonathan Horner
(74) *Attorney, Agent, or Firm* — Harness, Dickey & Pierce, P.L.C.

(57) ABSTRACT

An electrophoretic display device includes a common electrode, pixel electrodes, and a disperse system of electrophoretic particles. A transistor supplies one of the pixel electrodes with a first potential or a second potential higher than the first potential. During a first period, a control portion supplies a third potential to the gate electrode to turn on the transistor, supplies the first potential to a signal line or the common electrode, and supplies the second potential to the other line. During a second period, the control portion supplies a fourth potential higher than the third potential to the gate electrode to turn off the transistor, and supplies the first potential to both the signal line and the common electrode so that the pixel electrode potential substantially reaches the common electrode potential. The third potential is lower than the second potential and the fourth potential is higher than the first potential.

13 Claims, 8 Drawing Sheets

ELECTROPHORETIC DISPLAY DEVICE, ELECTRONIC APPARATUS, AND METHOD OF DRIVING ELECTROPHORETIC DISPLAY DEVICE

BACKGROUND

1. Technical Field

The present invention relates to an electrophoretic display device, an electronic apparatus, and a method of driving an electrophoretic display device.

2. Related Art

An electrophoretic display device is formed so that electrophoretic fluid dispersion that includes one or more types of electrophoretic particles and an electrophoretic dispersion medium is sealed between a pair of opposite electrode plates, at least one of which is transparent. Applying a voltage between the two electrodes causes electrophoretic particles to move in the electrophoretic dispersion medium, and a change in dispersion of the electrophoretic particles varies optical reflection property to thereby make it possible to display information. At this time, if one of the electrodes is formed of a plurality of divided pixel electrodes, by controlling an electric potential of each pixel electrode, a difference in dispersion of particles in each pixel is produced to thereby make it possible to form an image.

Each pixel electrode is connected to a TFT (Thin Film Transistor), which is a switching element. By applying a predetermined voltage to the gate electrode of the TFT, the TFT enters an on state to cause a drain current to flow, so that the connected pixel electrode is supplied with an image signal. Note that it has been suggested that the TFT may employ a flexible, light organic transistor that allows cost reduction.

JP-A-2002-149115 describes an active matrix electrophoretic display device that uses electronic ink. The electrophoretic display device described in JP-A-2002-149115 employs a driving method in which, when a display content is changed, all the pixel electrodes are set to the same electric potential and a voltage is applied between the common electrode and the pixel electrodes to thereby erase the content displayed at that time over the entire display area, and, after that, another display content is displayed.

When a TFT is made to enter an on state, for example, a P-type transistor is applied with a negative voltage and an N-type transistor is applied with a positive voltage; however, in terms of transistor structure, it has been known that, if the gate electrode of a P-type transistor is applied with a negative bias voltage or the gate electrode of an N-type transistor is applied with a positive bias voltage, carriers are trapped on a semiconductor surface. Trapping of carriers leads to fluctuation in threshold voltage at a boundary between an on state and an off state of a transistor or fluctuation in drain current in an on state of the transistor. This results in a decrease in contrast of the electrophoretic display device or may produce a problem such as nonoperation of the electrophoretic display device in some cases. Particularly, the organic transistor noticeably has a problem of characteristic degradation due to the carrier trap. The above problem regarding fluctuation in threshold in an organic transistor is also described in "Bias-induced threshold voltages shifts in thin-film organic transistors" H. L. Gomes, P. Stallinga, et. al., APPLIED PHYSICS LETTERS, Vol. 84, No. 16, 19 APR. 2004, p 3184-p 3186 and "Light-induced bias stress reversal in polyfluorene thin-film transistors" A. Salleo, R. A. Street, JOURNAL OF APPLIED PHYSICS, Vol. 94, No. 1, 1 JUL. 2003, p 471-p 479.

SUMMARY

An advantage of some aspects of the invention is that it suppresses degradation of characteristic of a transistor used as a switching element, and maintains the display quality of the electrophoretic display device.

An aspect of the invention provides an electrophoretic display device that includes an electrophoretic element, having disperse system containing electrophoretic particles, that is held between a common electrode and a plurality of pixel electrodes, and a display portion formed of a plurality of pixels. The electrophoretic display device includes switching transistors and a control portion. Each of the switching transistors supplies a corresponding one of the pixel electrodes with a low electric potential signal or a high electric potential signal supplied from a signal line. The control portion controls electric potential signals supplied to the pixel electrodes and the common electrode to cause the electrophoretic particles to move to thereby form an image. Each switching transistor enters an on state when a gate electrode of the switching transistor is supplied with a first electric potential, and enters an off state when the gate electrode is supplied with a second electric potential. The control portion is provided with a first period during which control for causing the electrophoretic particles to move is performed and a second period during which, after the first period, the switching transistors are made to enter an off state. During the second period, when the first electric potential is smaller than the second electric potential, the control portion supplies a low electric potential signal from the signal line to the switching transistors and supplies a low electric potential signal to the common electrode, whereas when the first electric potential is larger than the second electric potential, the control portion supplies a high electric potential signal from the signal line to the switching transistors and supplies a high electric potential signal to the common electrode.

According to the above aspect of the invention, for the switching transistors that are configured to enter an on state with a negative voltage, during the second period, the switching transistors are made to enter an off state and a data signal is set to a low electric potential, and a discharging phenomenon of the electrophoretic element is used to apply a low electric potential voltage to the common electrode to thereby set the electric potentials of the pixel electrodes to a low electric potential. By so doing, in all the pixels, the gate electrode of the switching transistor is at a high electric potential and the source electrode and drain electrode of the switching transistor are at a low electric potential, and then the gate electrode of the switching transistor is applied with a positive bias voltage. In this manner, degradation of characteristic, which arises because a negative bias voltage is applied to the gate electrode during the first period, may be recovered during the second period, and the display quality of the electrophoretic display device may be maintained.

Similarly, for the switching transistors that are configured to enter an on state with a positive voltage, during the second period, the switching transistors are made to enter an off state and a data signal is set to a high electric potential, and a discharging phenomenon of the electrophoretic element is used to apply a high electric potential voltage to the common electrode to thereby set the electric potentials of the pixel electrodes to a high electric potential. By so doing, in all the pixels, the gate electrode of the switching transistor is at a low electric potential and the source electrode and drain electrode of the switching transistor are at a high electric potential, and then the gate electrode of the switching transistor is applied with a negative bias voltage. In this manner, degradation of characteristic, which arises because a positive bias voltage is applied to the gate electrode during the first period, may be recovered during the second period, and the display quality of the electrophoretic display device may be maintained.

In the above electrophoretic display device, the first period may include an image writing period and a reset period. Because, during the image writing period and the reset period, the switching transistors are made to enter an on state for a relatively long period of time in order to cause electrophoretic particles to move, by providing the second period after these periods, it is possible to effectively recover degradation of characteristic of the switching transistors.

In the above electrophoretic display device, the second period may be set to a period during which the pixel electrodes are able to attain the same electric potential as that of the common electrode. Note that time that is taken for the pixel electrodes to become a low electric potential is determined depending on an impedance of the electrophoretic element.

In the above electrophoretic display device, the control portion may be provided with the second period periodically at a certain time interval. In the above electrophoretic display device, the control portion may short-circuit the common electrode and the signal line during the second period. By so doing, it is possible to change an electric potential of the common electrode with a simple manner.

In the above electrophoretic display device, during the second period, when the first electric potential is smaller than the second electric potential, the control portion may perform at least one of setting an electric potential, applied to each gate electrode, to a third electric potential larger than the second electric potential and setting an electric potential, applied to the signal line and the common electrode, to a fourth electric potential smaller than the low electric potential signal, and when the first electric potential is larger than the second electric potential, the control portion may perform at least one of setting an electric potential, applied to each gate electrode, to a fifth electric potential smaller than the second electric potential and setting an electric potential, applied to the signal line and the common electrode, to a sixth electric potential larger than the high electric potential signal. By so doing, during the second period, a further large positive bias voltage or negative bias voltage is applied to the gate electrode of each switching transistor, so that further high recovery effect against degradation of characteristic is obtained.

In the above electrophoretic display device, each switching transistor may be, for example, an organic thin film transistor. The organic thin film transistor noticeably has a problem of characteristic degradation due to the carrier trap, so that it is possible to further effectively maintain the display quality of the electrophoretic display device.

Another aspect of the invention provides any electronic apparatuses that include the above described electrophoretic display device as a display portion. The electronic apparatuses include a display device, a television device, an electronic book, an electronic paper, a watch, a clock, an electronic calculator, a cellular phone, and a personal digital assistant. In addition, the electronic apparatuses, for example, include a product that is apart from the concept of "apparatus", such as a flexible paper-like or film-like object, a product that belongs to a real estate, such as a wall surface to which the above object is affixed, and a product that belongs to a movable body, such as a vehicle, an aircraft, and a ship.

Further another aspect of the invention provides a method of driving an electrophoretic display device that includes an electrophoretic element, having disperse system containing electrophoretic particles, that is held between a common electrode and a plurality of pixel electrodes, a display portion formed of a plurality of pixels, and switching transistors, each of which supplies a corresponding one of the pixel electrodes with a low electric potential signal or a high electric potential signal supplied from a signal line, wherein electric potential signals supplied to the pixel electrodes and the common electrode are controlled to cause the electrophoretic particles to move to thereby form an image. The method includes: performing control for causing the electrophoretic particles to move; and making each switching transistor to enter an off state, wherein each switching transistor enters an on state when a gate electrode of the switching transistor is supplied with a first electric potential and enters an off state when the gate electrode is supplied with a second electric potential, wherein during times when each switching transistor is made to enter an off state, when the first electric potential is smaller than the second electric potential, a low electric potential signal is supplied from the signal line to each switching transistor and a low electric potential signal is supplied to the common electrode, and when the first electric potential is larger than the second electric potential, a high electric potential signal is supplied from the signal line to each switching transistor and a high electric potential signal is supplied to the common electrode.

According to the above aspect of the invention, for the switching transistors that are configured to enter an on state with a negative voltage, during times when the switching transistors are made to enter an off state, a data signal is set to a low electric potential, and a discharging phenomenon of the electrophoretic element is used to apply a low electric potential voltage to the common electrode to thereby set the electric potentials of the pixel electrodes to a low electric potential. By so doing, in all the pixels, the gate electrode of the switching transistor is at a high electric potential and the source electrode and drain electrode of the switching transistor are at a low electric potential, and then the gate electrode of the switching transistor is applied with a positive bias voltage. In this manner, degradation of characteristic, which arises because a negative bias voltage is applied to the gate electrode during times when the control for causing the electrophoretic particles to move is performed, may be recovered during times when the switching transistors are made to enter an off state, and the display quality of the electrophoretic display device may be maintained.

Similarly, for the switching transistors that are configured to enter an on state with a positive voltage, during times when the switching transistors are made to enter an off state, a data signal is set to a high electric potential, and a discharging phenomenon of the electrophoretic element is used to apply a high electric potential voltage to the common electrode to thereby set the electric potentials of the pixel electrodes to a high electric potential. By so doing, in all the pixels, the gate electrode of the switching transistor is at a low electric potential and the source electrode and drain electrode of the switching transistor are at a high electric potential, and then the gate electrode of the switching transistor is applied with a negative bias voltage. In this manner, degradation of characteristic, which arises because a positive bias voltage is applied to the gate electrode during times when the control for causing the electrophoretic particles to move is performed, may be recovered during times when the switching transistors are made to enter an off state, and the display quality of the electrophoretic display device may be maintained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described with reference to the accompanying drawings.

First Embodiment

Figure 1:
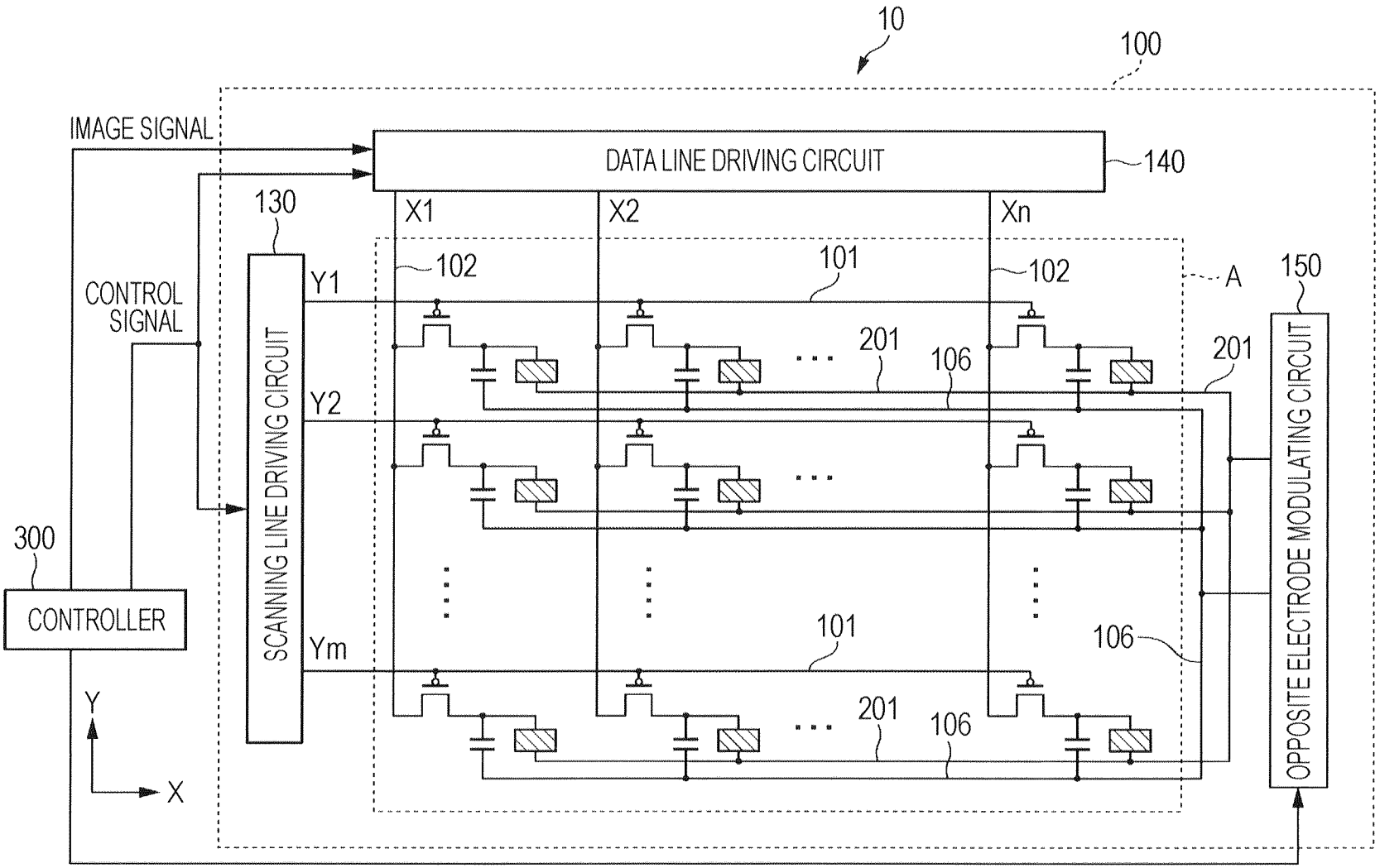
FIG. 1 is a view that shows a general electrical configuration of an electrophoretic display device according to a first embodiment of the invention.

FIG. 1 is a view that shows a general electrical configuration of an electrophoretic display device 10 according to a first embodiment. An electrophoretic display panel A (display portion) is formed of a plurality of pixels. Each of the pixels includes a TFT 103, which serves as a switching element described later, and a pixel electrode 104 connected to the TFT 103. On the other hand, a scanning line driving circuit 130 and a data line driving circuit 140 are formed in a peripheral area of a device substrate 100. In addition, a plurality of scanning lines 101 are formed on the electrophoretic display panel A of the device substrate 100 so as to be parallel to an X direction shown in the drawing. In addition, a plurality of data lines 102 are formed so as to be parallel to a Y direction that is perpendicular to the X direction. Then, pixels are arranged in a matrix at positions corresponding to intersections of the scanning lines 101 and the data lines 102.

A controller (control portion) 300 is provided in a peripheral circuit of the electrophoretic display device 10. The controller 300 includes an image signal processing circuit and a timing generator. Here, the image signal processing circuit generates image data and an opposite electrode control signal and input the image data and the opposite electrode control signal respectively into the data line driving circuit 140 and the opposite electrode modulating circuit 150. The opposite electrode modulating circuit 150 supplies a common electrode of the pixels and an opposite electrode of holding capacitors with a bias signal Vcom and a power supply voltage Vs, respectively. For example, resetting of an image is set with the bias signal Vcom (reset signal) of a predetermined positive or negative level. The reset signal is output in a predetermined period before the data line driving circuit 140 outputs image data. The resetting is used to attract electrophoretic particles, which migrate in a dispersion medium, to the pixel electrodes or the common electrode and initialize the spatial state. In addition, the timing generator, at the time of reset setting or when image data are output from the image signal processing circuit, generates various timing signals for controlling the scanning line driving circuit 130 or the data line driving circuit 140.

Figure 2:
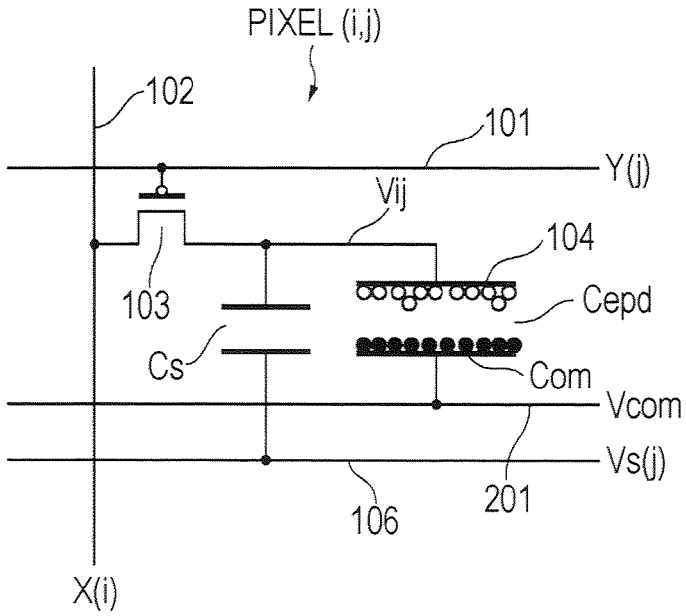
FIG. 2 is a view that shows a structure of each pixel of the electrophoretic display device.

FIG. 2 is a view that shows a structure of each pixel of the electrophoretic display device 10. A pixel (i,j) located at the i-th row and the j-th column is formed to include a TFT 103, a pixel electrode 104 and a holding capacitor Cs. Here, the TFT 103 is a P-type organic transistor. The gate terminal of the TFT 103 is connected to a corresponding one of the scanning lines 101, and the source terminal of the TFT 103 is connected to a corresponding one of the data lines 102. Furthermore, the drain terminal of the TFT 103 is connected to the pixel electrode 104 and the holding capacitor Cs. The holding capacitor Cs holds a voltage applied to the pixel electrode 104 using the TFT 103. Each pixel is formed so that an electrophoretic layer is held between the pixel electrode 104 and the common electrode Com, and has a pixel capacitor Cepd that is based on an electrode surface area, a distance between the electrodes, and a dielectric constant of the electrophoretic layer. The common electrode Com is connected through a wiring 201 to the opposite electrode modulating circuit 150. In addition, the other terminal of the holding capacitor Cs is connected to a holding capacitor line 106. The holding capacitor line 106 is connected to a power supply Vs at the opposite electrode modulating circuit 150.

Electrophoretic particles are particles (polymer or colloid) that electrically migrate in an electrophoretic dispersion medium owing to a difference in electric potential and move toward a desired electrode side. The electrophoretic particles, for example, include black pigment, such as aniline black and carbon black, white pigment, such as titanium dioxide, zinc white, antimony trioxide, and aluminum oxide, yellow pigment, such as azo-based pigment such as monoazo, disazo and polyazo, iso-indolynone, chrome yellow, yellow iron oxide, cadmium yellow, and antimony, red pigment, such as quinacridone red and chrome vermilion, blue pigment, such as phthalocyanine blue, indanthrene blue, anthraquinone-based dye, iron blue, ultramarine blue, and cobalt blue, and green pigment, such as phthalocyanine green.

In regard to driving of the thus configured electrophoretic display device 10, a reset operation will be described. At a reset timing, the scanning line driving circuit 130 outputs selection signals to all the scanning lines 101. Here, because the switching transistors are of P type, the selection signals are low electric potential signals. As all the scanning line signals become active, the TFTs 103 connected to all the pixels that are connected to these scanning lines 101 enter an on state. At this time, the data line driving circuit 140 outputs a high electric potential or a low electric potential to all the data lines. The signals are supplied to all the pixel electrodes. In addition, the opposite electrode modulating circuit 150 supplies a low electric potential signal to the common electrode Com when a high electric potential is supplied to all the data lines and supplies a high electric potential signal to the common electrode Com when a low electric potential is supplied to all the data lines. At this time, because the same difference in electric potential is applied between the pixel electrode of each pixel and the common electrode, the entire display portion appears to be the same gray-scale level.

Next, an image writing operation will be described. During image writing operation, the scanning line driving circuit 130 sequentially supplies a selection signal to the scanning lines 101. As the j-th scanning line 101 is supplied with a selection signal to enter a selected state, the TFT 103 connected to this scanning line 101 enters an on state. At this time, in synchronization with the selection of the scanning line, a data signal Xi (image signal) supplied from the data line driving circuit 140 is written to the pixel electrode 104. At this time, the holding capacitor Cs is charged at a voltage level of the data signal Xi to hold electric charge in the pixel (pixel electrode and common electrode) after interruption of the TFT 103, thus maintaining the image formed by the electrophoretic particles. Each pixel performs display corresponding to a voltage level of a data signal to thereby display an image.

Figure 3A:
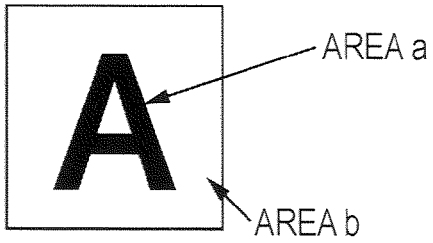
FIG. 3A to FIG. 3C are views that illustrate changes in a display portion of the electrophoretic display device when a display image is changed according to the first embodiment.
Figure 3B:
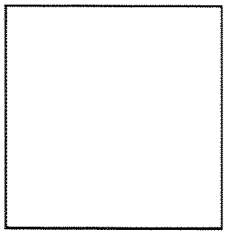
Figure 3C:
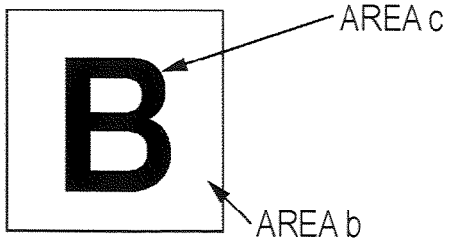
Figure 4:
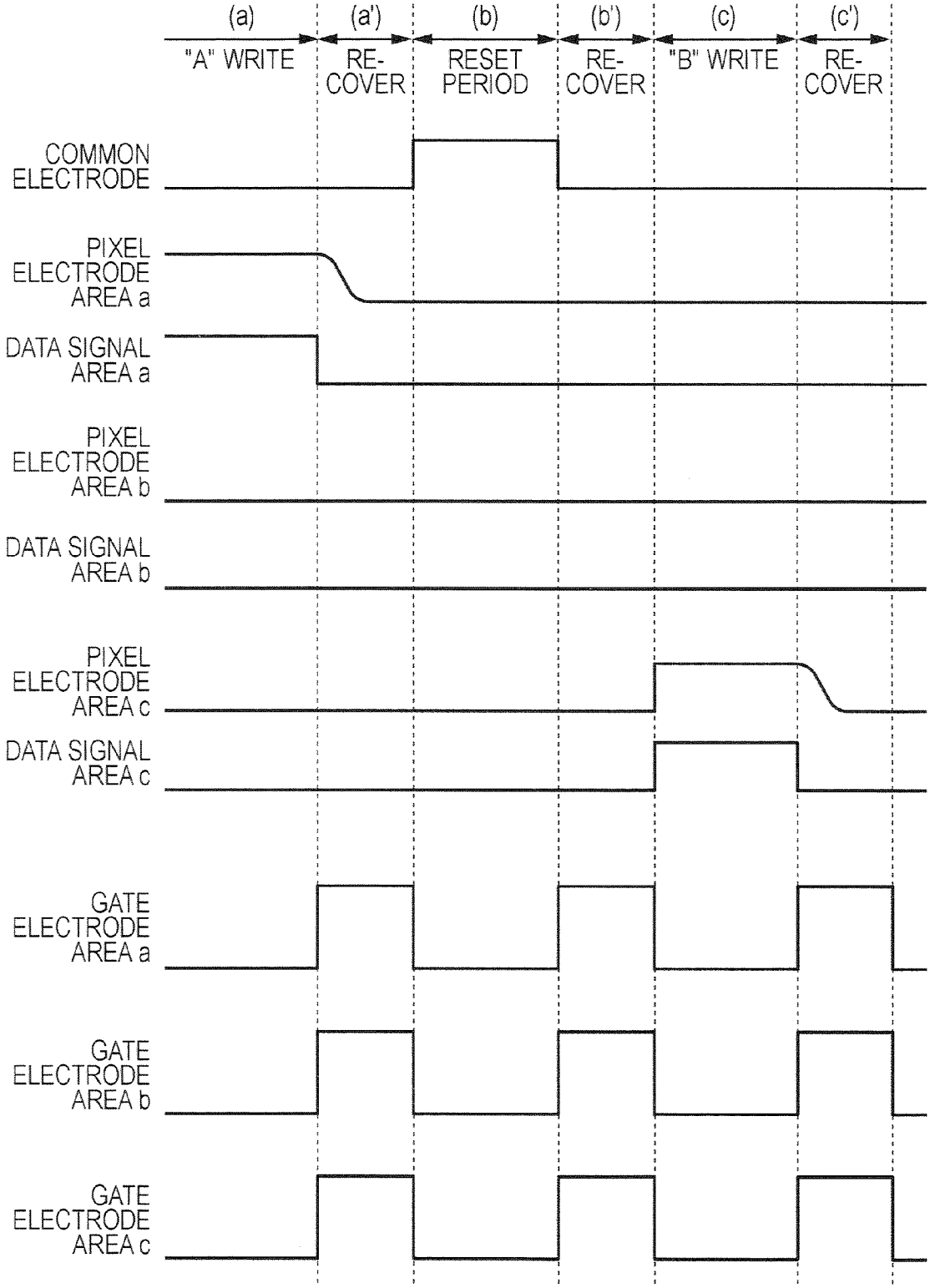
FIG. 4 is a timing chart that shows voltages of a common electrode, pixel electrode, data signal, and gate electrode of the electrophoretic display device according to the first embodiment.
Figure 5A:
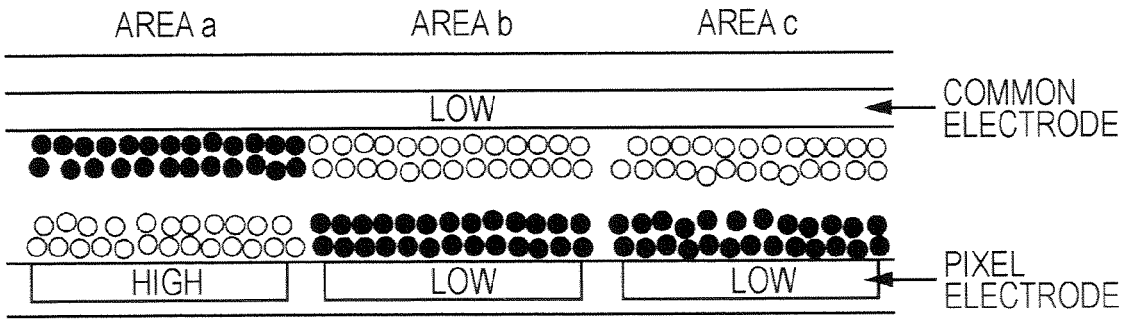
FIG. 5A to FIG. 5C are views that schematically show operations of the electrophoretic display device when a display image is changed according to the first embodiment.
Figure 5B:
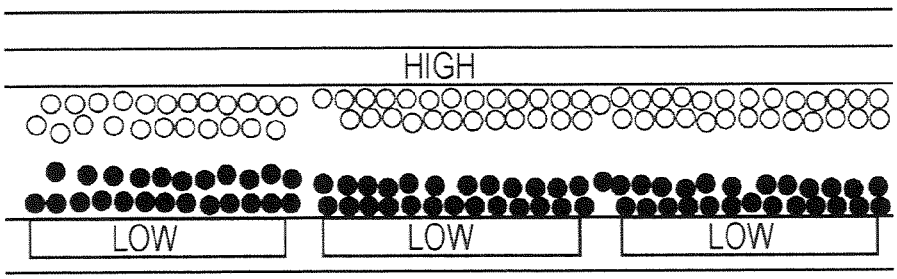
Figure 5C:
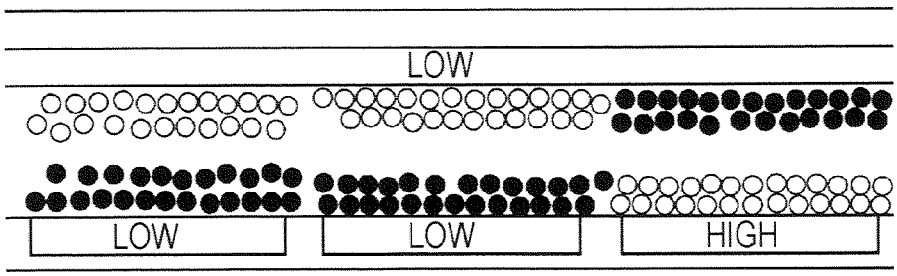

Next, a detailed operation of the electrophoretic display device 10 when a display image is changed will be described with reference to FIG. 3A to FIG. 5C. FIG. 3A to FIG. 3C are views that show a state of the display portion of the electrophoretic display device 10. FIG. 4 is a view that shows voltages applied to the common electrode Com, the pixel electrode 104, the data signal, and the gate electrode. FIG. 5A to FIG. 5C are views that schematically show operations of the electrophoretic display device 10 when a display image is changed. Here, the electrophoretic particles include white electrophoretic particles that are negatively charged and black electrophoretic particles that are positively charged.

FIG. 3A shows a state in which the black character "A" is displayed on the white background on the display portion of the electrophoretic display device 10. Here, the area of the character "A" is denoted as area a, and the area of the background other than the area of the character "A" is denoted as area b. The entire display portion appears to be white display immediately before "A" is displayed. At the time of writing "A", as shown in the period (a) in FIG. 4 (first period), the common electrode Com is applied with a low electric potential voltage. In addition, only the pixel electrodes 104 corresponding to the area a are applied with a high electric potential voltage, and the pixel electrodes 104 corresponding to the background area b are applied with a low electric potential voltage. By so doing, as shown in FIG. 5A, black electrophoretic particles that are positively charged move toward the common electrode Com only in the area a, and white electrophoretic particles that are negatively charged move toward the pixel electrodes 104. Thus, the character "A" is displayed. Strictly speaking, the area b shown in FIG. 3A and the area b shown in FIG. 3C respectively include different areas; however, for easier description, a description is made using the same reference sign assigned to these areas in the context that these are background areas, other than the character region, to which the same electric potential is applied.

Next, during the period (a') shown in FIG. 4 (second period), the gate electrodes of each area are applied with a high electric potential voltage, so that the TFTs 103 enter an off state. Furthermore, the common electrode Com is applied with a low electric potential voltage, and a low electric potential data signal is supplied from the data line 102 of each pixel to the TFT 103. As shown in the drawing, in the period (a'), the electric potentials of the pixel electrodes 104 in the area a change from a high electric potential to a low electric potential. Hereinafter, changes in the electric potential of the pixel electrode 104 during the period (a') will be described with reference to FIG. 6.

Figure 6:
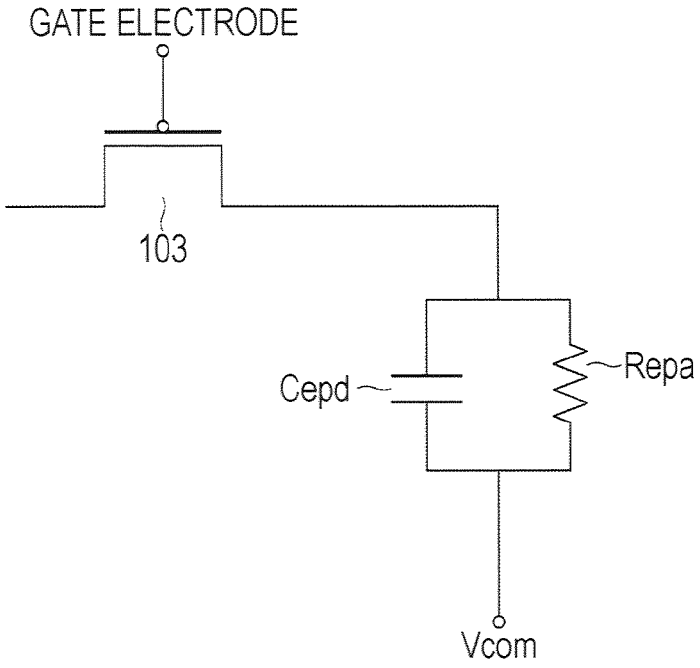
FIG. 6 is an equivalent circuit of an electrophoretic element.
Figure 7A:
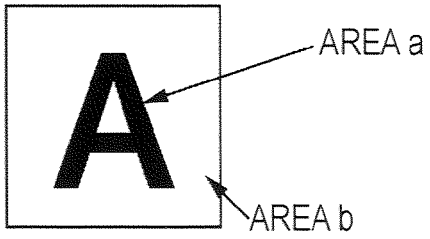
FIG. 7A to FIG. 7C are views that illustrate changes in the display portion of the electrophoretic display device when a display image is changed according to an alternative example of the first embodiment.
Figure 7B:
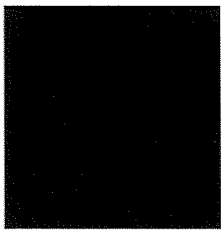
Figure 7C:
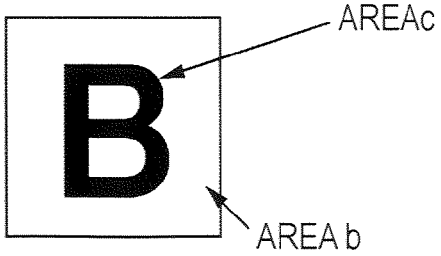

FIG. 6 is an equivalent circuit of an electrophoretic element. As shown in the drawing, each electrophoretic element is presumably equivalent to a circuit in which a pixel capacitor Cepd and a resistance Repd are connected in parallel with each other. In the above circuit, as the TFT 103 enters an off state, no charging current is supplied to the pixel capacitor Cepd, and a discharging current flows from the pixel capacitor Cepd to the resistance Repd. Thus, as a low electric potential voltage is applied to the common electrode Com, the electric potential of the pixel electrode 104 also becomes a low electric potential equal to the common electrode Com after a certain period of time. Time that is taken for the pixel electrode 104 to become a low electric potential is determined depending on an impedance of the electrophoretic element.

Thus, during the period (a'), in all the pixels, the gate electrode of the TFT 103 is at a high electric potential, and the source electrode and drain electrode of the TFT 103 are at a low electric potential, so that the gate electrode of the TFT 103 is applied with a positive bias voltage. This makes it possible to recover degradation of characteristic due to a negative bias voltage applied during the period (a).

Next, FIG. 3B shows a state during a reset period, and an image is erased by making the entire display portion perform white display before a display image is changed. During the reset period, as shown in the period (b) in FIG. 4 (first period), the common electrode Com is applied with a high electric potential voltage. In addition, the gate electrodes of all the TFTs 103 are applied with a low electric potential to make all the TFTs 103 turn on, and all the pixel electrodes 104 are applied with a low electric potential voltage. By so doing, as shown in FIG. 5B, black electrophoretic particles move toward the pixel electrodes 104 in the area a, so that the entire display portion appears to be white.

As shown in FIG. 4, after the reset period (b) as well, the period (b') (second period) is provided, and the gate electrodes of each area are applied with a high electric potential voltage, so that the TFTs 103 enter an off state. Furthermore, the common electrode Com is applied with a low electric potential voltage, and a low electric potential data signal is supplied from the data line 102 of each pixel to the TFT 103.

Next, FIG. 3C shows that the black character "B" is displayed on the white background on the display portion. Here, the area of the character "B" is denoted as area c. At the time of writing "B", as shown in the period (c) in FIG. 4 (first period), the common electrode Com is applied with a low electric potential voltage. In addition, the pixel electrodes 104 corresponding to the area c are applied with a high electric potential voltage, and the pixel electrodes 104 corresponding to the area other than the area c are applied with a low electric potential voltage. By so doing, as shown in FIG. 5C, black electrophoretic particles that are positively charged move toward the common electrode Com only in the area c. Thus, the character "B" is displayed.

As shown in FIG. 4, after the period (c) as well, the period (c') (second period) is provided, and the gate electrodes of each area are applied with a high electric potential voltage, so that the TFTs 103 enter an off state. Furthermore, the common electrode Com is applied with a low electric potential voltage, and a low electric potential data signal is supplied from the data line 102 of each pixel to the TFT 103. By so doing, in the period (c'), the electric potentials of the pixel electrodes 104 in the area c change from a high electric potential to a low electric potential.

Thus, in the present embodiment, after the image writing period and the reset period, the TFTs 103 are made to enter an off state, the data signal of each pixel is set to a low electric potential, and the common electrode Com is applied with a low electric potential voltage, the electric potential of each pixel electrode 104 is also set to a low electric potential. By so doing, in all the pixels, the gate electrode of the TFT 103 is at a high electric potential, and the source electrode and drain electrode of the TFT 103 are at a low electric potential, so that the gate electrode of the TFT 103 is applied with a positive bias voltage. As described above, if the gate electrode of a P-type transistor is applied with a negative bias voltage, degradation of characteristic due to carrier trap occurs. According to the present embodiment, because a recovery period (a'), (b'), or (c') in which a positive bias voltage is applied is respectively provided after the gate electrodes of the TFTs 103 are applied with a negative bias voltage during the reset period (b) or the image writing period (a) or (c), it is possible to suppress characteristic degradation of the transistors due to carrier trap, and also it is possible to maintain the display quality of the electrophoretic display device.

Figure 8:
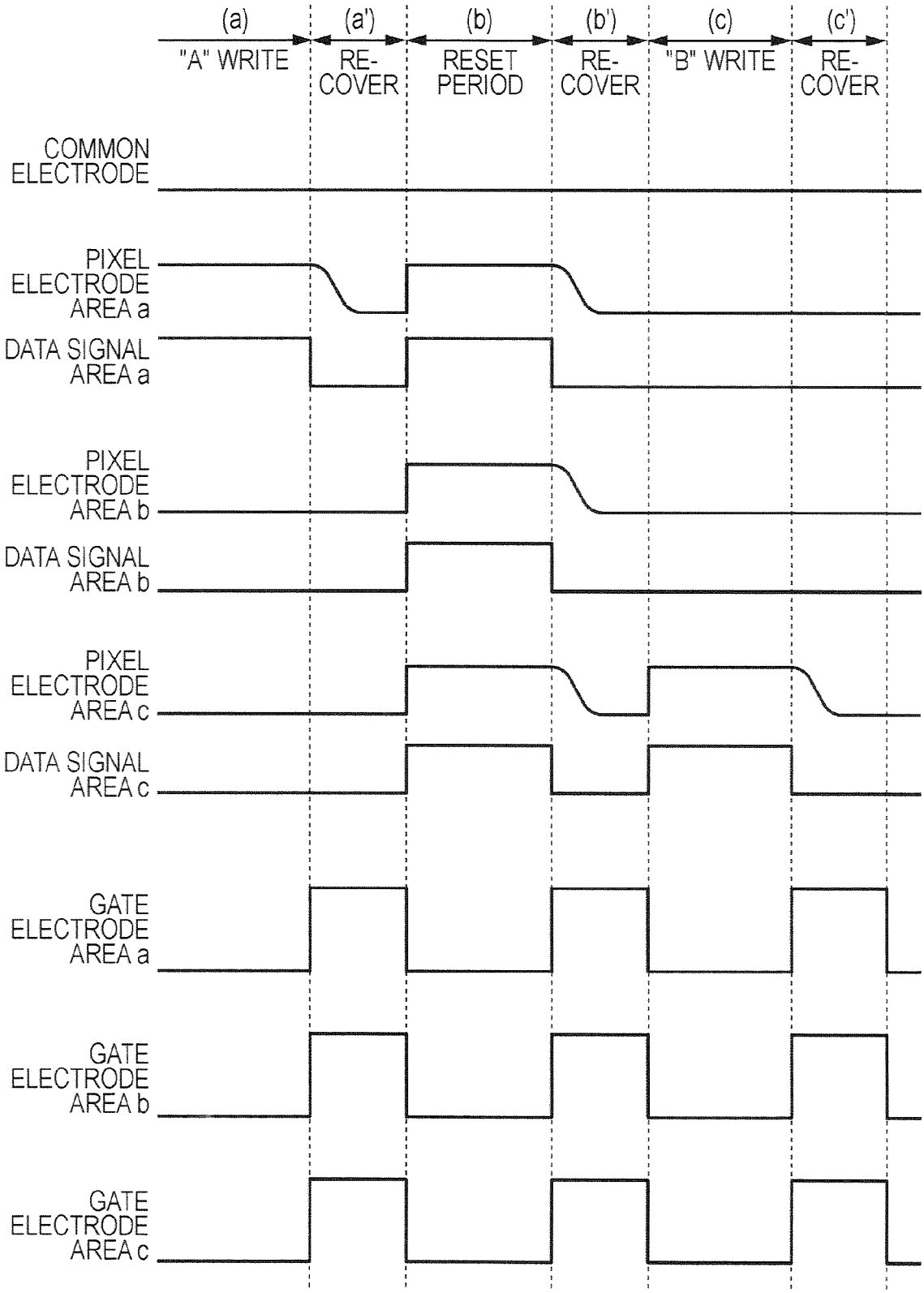
FIG. 8 is a timing chart that shows voltages of a common electrode, pixel electrode, data signal, and gate electrode of the electrophoretic display device according to the alternative example of the first embodiment.
Figure 9A:
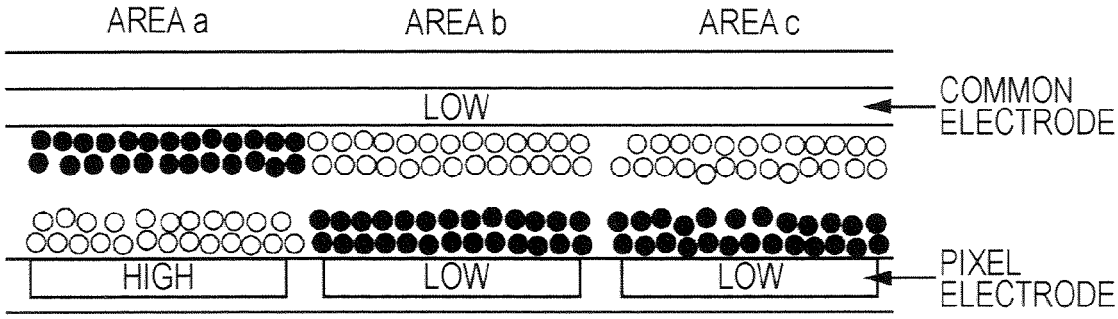
FIG. 9A to FIG. 9C are views that schematically show operations of the electrophoretic display device when a display image is changed according to the alternative example of the first embodiment.
Figure 9B:
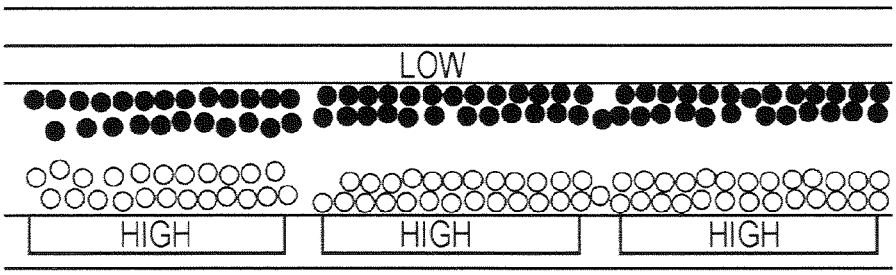
Figure 9C:
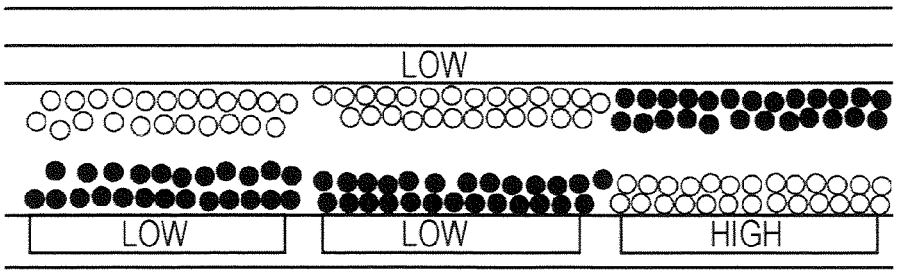

In addition, the entire display portion performs white display during the reset period in the example shown in FIG. 3A to FIG. 5C; however, as shown in FIG. 7A to FIG. 9C, a method to make the entire display portion perform black display during the reset period may be employed. As shown in the drawing, only the operation during the reset period (b) is different from that of the example shown in FIG. 3A to FIG. 5C. As shown in FIG. 7B, the entire display portion performs black display during the reset period. As shown in FIG. 8, during the reset period (b), the common electrode Com is applied with a low electric potential voltage, and all the pixel electrodes 104 are applied with a high electric potential voltage. By so doing, as shown in FIG. 9B, white electrophoretic particles move toward the pixel electrodes 104 in the areas b and c, so that the entire display portion appears to be black.

In this case as well, as shown in FIG. 8, after the reset period (b) (first period), the period (b') (second period) is provided, and the gate electrodes of each area are applied with a high electric potential voltage, so that the TFTs 103 enter an off state. Furthermore, a low electric potential data signal is supplied from the data line 102 of each pixel to the TFT 103. In addition, when the common electrode Com is applied with a low electric potential voltage, the electric potential of each pixel electrode 104 of each area changes from a high electric potential to a low electric potential. By so doing, in all the pixels, the gate electrode of the TFT 103 is at a high electric potential, and the source electrode and drain electrode of the TFT 103 are at a low electric potential, so that the gate electrode of the TFT 103 is applied with a positive bias voltage. This makes it possible to recover degradation of characteristic due to a negative bias voltage applied during the period (a), (b), or (c). Strictly speaking, the area b shown in FIG. 7A and the area b shown in FIG. 7C respectively include different areas; however, for easier description, a description is made using the same reference sign assigned to these areas in the context that these are background areas, other than the character region, to which the same electric potential is applied.

Note that in the present embodiment, the TFTs 103 are P-type organic transistors; however, the TFTs 103 may be N-type organic transistors. In this case, to make the TFT 103 enter an on state, the gate electrode is applied with a positive voltage; however, if the N-type transistor is applied with a positive bias voltage, degradation of characteristic due to carrier trap occurs. Thus, as in the case of the present embodiment, after the reset period and the image writing period, the TFTs 103 are applied with a low electric potential voltage to make the TFTs 103 enter an off state, the data signal of each pixel is set to a high electric potential, and a period is provided during which the common electrode Com is applied with a high electric potential voltage to set the electric potential of each pixel electrode 104 to a high electric potential. By so doing, in all the pixels, the gate electrode of the TFT 103 is at a low electric potential, and the source electrode and drain electrode of the TFT 103 are at a high electric potential, so that the gate electrode of the TFT 103 is applied with a negative bias voltage. Thus, it is possible to recover degradation of characteristic due to a positive bias voltage applied during the reset period and the image writing period.

In addition, in the present embodiment, the electrophoretic particles include white electrophoretic particles that are negatively charged and black electrophoretic particles that are positively charged; however, the configuration of the electrophoretic particles are not limited to it. For example, when the electrophoretic particles include white electrophoretic particles that are positively charged and black electrophoretic particles that are negatively charged, or when color particles other than black or white are employed, the same advantageous effects may also be obtained.

In addition, in the first embodiment, the recovery period (second period) that continues for a certain period of time is provided between the image writing period and the reset period; instead, for example, the second period may be provided periodically at a certain time interval.

In addition, in the first embodiment, during the recovery period, the data signal of each pixel is set to a low electric potential, and the common electrode Com is applied with a low electric potential voltage; instead, for example, the common electrode Com and the source terminal of each TFT 103 are short-circuited to thereby make it possible to apply a low electric potential voltage to the common electrode Com.

Figure 10A:
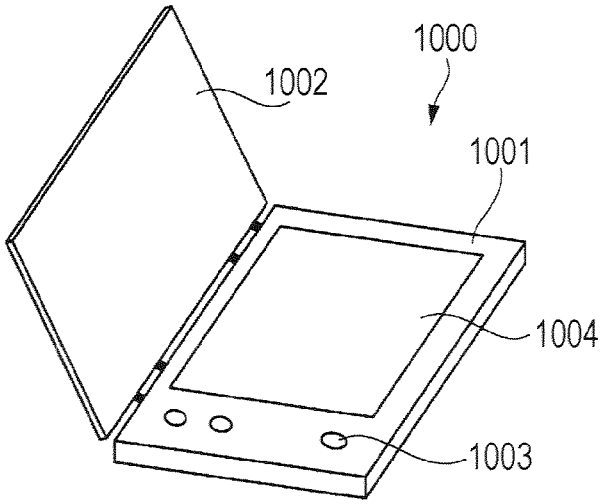
FIG. 10A to FIG. 10C are views that show examples of electronic apparatuses according to the aspects of invention.
Figure 10B:
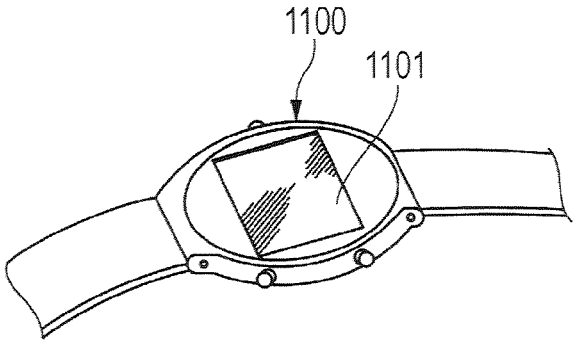
Figure 10C:
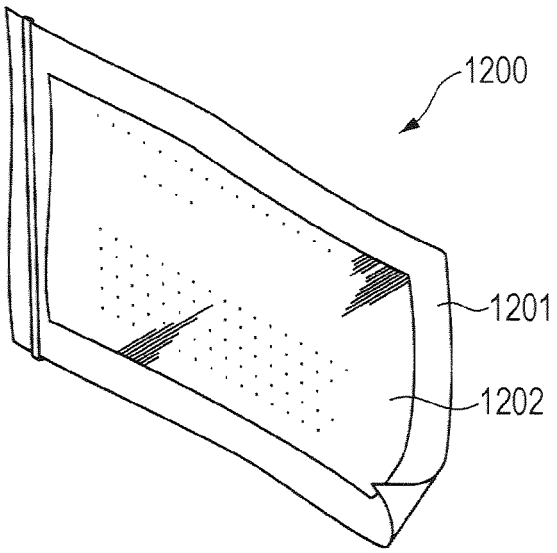

In addition, during the recovery period, a voltage applied to the gate electrode of each TFT 103 may be set to an electric potential (third electric potential) that is higher than that of the voltage of a signal that is set in advance as a scanning signal. Alternatively, during the recovery period, a low electric potential signal supplied to the source electrode of each TFT 103 and a low electric potential voltage applied to the common electrode Com may be set to an electric potential (fourth electric potential) that is lower than that of the voltage of a signal that is set as a data signal. In addition, the gate electrode of each TFT 103 is applied with an electric potential that is higher than that of the voltage of a signal that is set in advance as a scanning signal, and a low electric potential signal supplied to the source electrode of each TFT 103 and a low electric potential voltage applied to the common electrode Com may be set to an electric potential that is lower than that of the voltage of a signal that is set as a data signal. By so doing, during the recovery period, a further large positive bias voltage is applied to the gate electrode of each TFT 103, so that further high recovery effect against degradation of characteristic is obtained. Note that when the TFTs 103 are N-type organic transistors, during the recovery period, a voltage applied to the gate electrode of each TFT 103 may be set to an electric potential (fifth electric potential) that is lower than that of the voltage of a signal that is set in advance as a scanning signal. Alternatively, during the recovery period, a high electric potential signal supplied to the source electrode of each TFT 103 and a high electric potential voltage applied to the common electrode Com may be set to an electric potential (sixth electric potential) that is higher than that of the voltage of a signal that is set as a data signal. In addition, the gate electrode of each TFT 103 is applied with an electric potential that is lower than that of the voltage of a signal that is set in advance as a scanning signal, and a high electric potential signal supplied to the source electrode of each TFT 103 and a high electric potential voltage applied to the common electrode Com may be set to an electric potential that is higher than that of the voltage of a signal that is set as a data signal. By so doing, during the recovery period, a further large negative bias voltage is applied to the gate electrode of each TFT 103, so that further high recovery effect against degradation of characteristic is obtained. Electronic Apparatuses FIG. 10A to FIG. 10C are perspective views that illustrate specific examples of an electronic apparatus that employs the electrophoretic display device according to the aspects of the invention. FIG. 10A is a perspective view that shows an electronic book, which is an example of an electronic apparatus. The electronic book 1000 includes a book-shaped frame 1001, an (openable) cover 1002 provided pivotally to the frame 1001, an operating portion 1003, and a display portion 1004 constituted of the electrophoretic display device according to the aspects of the invention.

FIG. 10B is a perspective view that shows a watch, which is an example of an electronic apparatus. The watch 1100 includes a display portion 1101 constituted of the electrophoretic display device according to the aspects of the invention.

FIG. 10C is a perspective view that shows an electronic paper, which is an example of an electronic apparatus. The electronic paper 1200 includes a main body portion 1201 constituted of a flexible rewritable sheet having a similar texture to paper and a display portion 1202 constituted of the electrophoretic display device according to the aspects of the invention.

For example, an electronic book and an electronic paper are presumably used to repeatedly write characters on the white background thereof, so that it is necessary to remove a residual image at the time of erasing or a residual image over time. Note that the electronic apparatus to which the electrophoretic display device according to the aspects of the invention is applicable is not limited to the above, but it widely includes apparatuses that use changes in ocular hue in accordance with movement of electrically charged particles.

The entire disclosure of Japanese Patent Application No. 2007-269426, filed Oct. 16, 2007 is expressly incorporated by reference herein.

What is claimed is:

1. An electrophoretic display device comprising:

a common electrode;

a plurality of pixel electrodes;

a disperse system including electrophoretic particles, the disperse system being held between the common electrode and the plurality of pixel electrodes;

a switching transistor that supplies a corresponding one of the plurality of pixel electrodes with a first electric potential signal or a second electric potential signal that is higher than the first electric potential signal, wherein the first electric potential signal or the second electric potential signal is supplied from a signal line; and a control portion that controls electric potential signals supplied to the pixel electrode and the common electrode to cause the electrophoretic particles to move, wherein:

the switching transistor enters an on state when a gate electrode of the switching transistor is supplied with a third electric potential signal, and enters an off state when the gate electrode is supplied with a fourth electric potential signal that is higher than the third electric potential signal;

during a first period, the control portion supplies the third electric potential signal to the gate electrode of the switching transistor to place the switching transistor in the on state, supplies the first electric potential signal to one of the signal line and the common electrode, and supplies the second electric potential signal to the other of the signal line and the common electrode;

during a second period that is after supplying the first or second electric potential signal to the corresponding one of the plurality of pixel electrodes, the control portion (i) supplies a fifth electric potential signal to the gate electrode of the switching transistor to place the switching transistor in the off state, and (ii) performs setting an electric potential, applied to the signal line and the common electrode, to a sixth electric potential that is lower than the first electric potential signal;

the third electric potential signal is lower than the second electric potential signal and the fourth electric potential signal is higher than the first electric potential signal; and the control portion:

executes control according to the first period to perform an erase operation;

immediately following the erase operation, executes control according to the second period to perform a first recovery operation;

immediately following the first recovery operation, executes control according to the first period to perform an image writing operation; and immediately following the image writing operation, executes control according to the second period to perform a second recovery operation.

2. The electrophoretic display device according to claim 1, wherein the control portion is provided with the second period periodically at a certain time interval.

3. The electrophoretic display device according to claim 1, wherein the control portion short-circuits the common electrode and the signal line during the second period.

4. The electrophoretic display device according to claim 1, wherein the switching transistor is an organic thin film transistor.

5. An electronic apparatus comprising the electrophoretic display device according to claim 1.

6. A method of driving an electrophoretic display device that includes a common electrode and a plurality of pixel electrodes, a disperse system, including electrophoretic particles, that is held between the common electrode and the plurality of pixel electrodes, and a switching transistor that supplies a corresponding one of the pixel electrodes with a first electric potential signal or a second electric potential signal that is higher than the first electric potential signal, wherein the first electric potential signal or the second electric potential signal is supplied from a signal line, wherein electric potential signals supplied to the pixel electrode and the common electrode are controlled to cause the electrophoretic particles to move, the method comprising:

performing control for causing the electrophoretic particles to move, wherein the switching transistor enters an on state when a gate electrode of the switching transistor is supplied with a third electric potential signal and enters the off state when the gate electrode is supplied with a fourth electric potential signal that is higher than the third electric potential signal;

during a first period, supplying the third electric potential signal to the gate electrode of the switching transistor to place the switching transistor in the on state, supplying the first electric potential signal to one of the signal line and the common electrode, and supplying the second electric potential signal to the other of the signal line and the common electrode;

during a second period that is after supplying the first or second electric potential signal to the corresponding one of the plurality of pixel electrodes, (i) supplying a fifth electric potential signal to the gate electrode of the switching transistor to place the switching transistor in the off state, and (ii) setting an electric potential, applied to the signal line and the common electrode, to a sixth electric potential that is lower than the first electric potential signal, wherein the third electric potential signal is lower than the fourth electric potential signal, the third electric potential signal is lower than the second electric potential signal, and the fourth electric potential signal is higher than the first electric potential signal;

executing control according to the first period to perform an erase operation;

immediately following the erase operation, executing control according to the second period to perform a first recovery operation;

immediately following the first recovery operation, executing control according to the first period to perform an image writing operation; and immediately following the image writing operation, executing control according to the second period to perform a second recovery operation.

7. An electrophoretic display device comprising:

a common electrode;

a plurality of pixel electrodes;

a disperse system including electrophoretic particles, the disperse system being held between the common electrode and the plurality of pixel electrodes;

a switching transistor, which supplies a corresponding one of the plurality of pixel electrodes with a first electric potential signal or a second electric potential signal that is lower than the first electric potential signal, wherein the first electric potential signal or the second electric potential signal is supplied from a signal line; and a control portion that controls electric potential signals supplied to the pixel electrode and the common electrode to cause the electrophoretic particles to move, wherein:

the switching transistor enters an on state when a gate electrode of the switching transistor is supplied with a third electric potential signal, and enters an off state when the gate electrode is supplied with a fourth electric potential signal that is lower than the third electric potential signal;

during a first period, the control portion supplies the third electric potential signal to the gate electrode of the switching transistor to place the switching transistor in the on state, supplies the first electric potential signal to one of the signal line and the common electrode, and supplies the second electric potential signal to the other of the signal line and the common electrode;

during a second period that is after supplying the first or second electric potential signal to the plurality of pixel electrodes, the control portion (i) supplies a fifth electric potential signal to the gate electrode of the switching transistor to place the switching transistor in the off state, and (ii) performs setting an electric potential, applied to the signal line and the common electrode, to a sixth electric potential that is higher than the first electric potential signal;

the third electric potential signal is higher than the second electric potential signal and the fourth electric potential signal is lower than the first electric potential signal; and the control portion:

executes control according to the first period to perform an erase operation;

immediately following the erase operation, executes control according to the second period to perform a first recovery operation;

immediately following the first recovery operation, executes control according to the first period to perform an image writing operation; and immediately following the image writing operation, executes control according to the second period to perform a second recovery operation.

8. The electrophoretic display device according to claim 1, wherein the fifth electric potential and the fourth electric potential are equal.

9. The electrophoretic display device according to claim 1, wherein the fifth electric potential is higher than the fourth electric potential.

10. The method according to claim 6, wherein the fifth electric potential and the fourth electric potential are equal.

11. The method according to claim 6, wherein the fifth electric potential is higher than the fourth electric potential.

12. The electrophoretic display device according to claim 7, wherein the fifth electric potential and the fourth electric potential are equal.

13. The electrophoretic display device according to claim 7, wherein the fifth electric potential is lower than the fourth electric potential.

* * * * *